US009574454B2

(12) United States Patent
Shurrock et al.

(10) Patent No.: US 9,574,454 B2
(45) Date of Patent: Feb. 21, 2017

(54) FULL ARC ADMISSION STEAM TURBINE

(71) Applicant: ALSTOM Technology Ltd, Baden (CH)

(72) Inventors: Timothy George Shurrock, Warwickshire (GB); Robert Cunningham, Warwickshire (GB)

(73) Assignee: General Electric Technology GmbH, Baden (CH)

( * ) Notice: Subject to any disclaimer, the term of this patent is extended or adjusted under 35 U.S.C. 154(b) by 388 days.

(21) Appl. No.: 14/341,336

(22) Filed: Jul. 25, 2014

(65) Prior Publication Data

US 2015/0050134 A1 Feb. 19, 2015

(30) Foreign Application Priority Data

Aug. 14, 2013 (EP) ..... 13180320

(51) Int. Cl.

| | |
|---|---|
| ***F01D 9/02*** | (2006.01) |
| ***F01D 9/04*** | (2006.01) |
| ***F01D 9/06*** | (2006.01) |
| ***F01D 17/18*** | (2006.01) |
| ***F01D 25/24*** | (2006.01) |

(52) U.S. Cl.

CPC ..... *F01D 9/047* (2013.01); *F01D 9/02* (2013.01); *F01D 9/04* (2013.01); *F01D 9/06* (2013.01); *F01D 17/18* (2013.01); *F01D 25/24* (2013.01); *F01D 25/246* (2013.01); *F05D 2220/31* (2013.01)

(58) Field of Classification Search

CPC ..... F01D 9/02; F01D 9/04; F01D 9/047; F01D 9/06; F01D 25/24; F01D 25/246; F05D 2230/31; F05D 2240/10; F05D 2240/128; F05D 2240/14

See application file for complete search history.

(56) References Cited

U.S. PATENT DOCUMENTS 2,651,495 A * 9/1953 Corbett ..... F01D 9/047 415/139
4,847,039 A 7/1989 Kendall et al.
(Continued)

FOREIGN PATENT DOCUMENTS

DE 10 2010 034 569 A1 2/2012
EP 1 847 689 A2 10/2007

*Primary Examiner* — Jay Liddle
*Assistant Examiner* — Sang K Kim
(74) *Attorney, Agent, or Firm* — GE Global Patent Operation; Cynthia W. Flanigan

(57) ABSTRACT

The invention relates to a full arc admission steam turbine, which includes a plurality of nozzle boxes for inducing steam, and a plurality of nozzle plates for bearing nozzles, one nozzle plate corresponding to each nozzle box. The steam turbine 100 further includes a plurality of spacer plates corresponding to the plurality of nozzle boxes, wherein the spacer plate is disposed between the nozzle plate and the nozzle box, by which a flow path is formed between the plurality of nozzle boxes and the plurality of the nozzle plates through the plurality of spacer plates to achieve a full arc admission. With the solution according to embodiments of the present invention, existing partial arc steam turbine may be easily converted to be a full arc admission steam turbine. This will reduce cost of equipment upgrading. Outage due to onsite conversion may be significantly reduced.

8 Claims, 5 Drawing Sheets

(56) References Cited

U.S. PATENT DOCUMENTS

| | | | | |
|---|---|---|---|---|
| 6,196,793 | B1 * | 3/2001 | Braaten | F01D 9/047 415/191 |
| 6,631,858 | B1 | 10/2003 | Farineau et al. | |
| 7,207,773 | B2 * | 4/2007 | O'Clair | F01D 9/047 415/191 |
| 2003/0103845 | A1 * | 6/2003 | Hamlin | F01D 9/04 415/191 |

* cited by examiner

FULL ARC ADMISSION STEAM TURBINE

CROSS-REFERENCE TO RELATED APPLICATIONS

This application claims priority to European application 13180320.7 filed Aug. 14, 2013, the contents of which are hereby incorporated in its entirety.

TECHNICAL FIELD

The present invention relates to steam turbines, in particular, to full arc admission steam turbine, further in particular, to a full arc admission steam turbine converted from a partial arc admission steam turbine.

BACKGROUND

Generally, control of steam turbines comprises partial arc admission and full arc admission depending on whether all nozzles are active during operation. They have different advantages in respective application, which is known per se to those skilled in the art. Quite often, a partial arc admission steam turbine is required to be converted to be a full arc admission steam turbine, such as retrofitting exiting partial arc admission steam turbine and adapt to applications where full arc admission is desired.

Conventionally, a partial arc admission steam turbine comprises a plurality of nozzle boxes, at least two, which are assembled to be a complete circle, and which are communicated correspondingly with a plurality of nozzle plates, generally one nozzle box for each nozzle plate. To achieve full arc admission, the nozzle boxes could be removed. However, on some machines where the nozzle boxes are welded to the turbine casing, the removing requires significant site work and a long outage for this turbine. This approach also increases the duty of the existing outer casing of the turbine which makes it necessary to re-qualify the design hence imposing difficulty for implementation.

As another approach, the whole outer casing of the turbine may be replaced with new full arc admission casing. However, this solution is extremely expensive and requires site pipework welding and hence long outage.

As another approach, the pipework between the control valves and the casing can be joined to create the effect of full arc admission. However, this requires requalification of the pipework, which may involve complete upgrade of the system.

In view of this, there exists the need of a solution that may be used to convert existing partial arc steam turbine into full arc admission in a cost effective, operable, and reliable manner.

SUMMARY

It is an object of the present invention is to provide a full arc admission steam turbine, which comprises a plurality of nozzle boxes for inducing steam, and a plurality of nozzle plates for bearing nozzles, one nozzle plate corresponding to each nozzle box, the steam turbine further comprises a plurality of spacer plates corresponding to the plurality of nozzle boxes, wherein the spacer plate is disposed between the nozzle plate and the nozzle box, by which a flow path is formed between the plurality of nozzle boxes and the plurality of the nozzle plates through the plurality of spacer plates to achieve a full arc admission.

According to one example embodiment of the present invention, the spacer plate is configured to be part of a circle, and the spacer plate comprise an outer ring, an inner ring separated from the inner ring by a communication space formed as part of the flow path, and two link portions disposed at opposite leading and trailing ends of the outer ring and the inner ring to connect the outer ring and the inner ring, wherein the link portion has a less length in a axial direction of the steam turbine than that of the outer ring and the inner ring.

According to one example embodiment of the present invention, when two adjacent spacer plates are assembled in a head-to-toe manner, the link portion on the leading end of one of the two adjacent spacer plates rests against the link portion on the trailing end of the other of the two adjacent spacer plates.

According to one example embodiment of the present invention, when the plurality of the spacer plates are assembled in a head-to-toe manner, the flow path comprises a complete ring shape part around the axial direction of the steam turbine that is formed by the plurality of the spacer plates.

According to one example embodiment of the present invention, two series of fastener holes are disposed on the inner ring and the outer ring of the spacer plate, wherein one series of the two series of fastener holes is used to connect the spacer plate to the nozzle box, respectively, and the other series of the two series of fastener holes is used to connect the nozzle plate to the spacer plate, respectively.

According to one example embodiment of the present invention, one series of fastener holes are disposed on the inner ring or the outer ring of the spacer plate so as to be used to connect the nozzle plate, the spacer plate and the nozzle box together.

According to one example embodiment of the present invention, the spacer plate comprises on its leading end a protrusion and a recess on its trailing end, where, when two adjacent spacer plates are assembled, the protrusion on the leading end of one of the two spacer plates engage with the recess on the trailing end of the other of the two spacer plates.

According to one example embodiment of the present invention, the recess on the trailing end of the spacer plate consists of peripheral walls around the trailing end of the spacer plate, leaving an open side facing the nozzle plate when assembled.

According to one example embodiment of the present invention, the nozzle plate comprises on a side facing the spacer plate a hook, and the spacer plate comprises on a side facing the nozzle plate a notch, where the hook on the nozzle plate engages with the notch on the spacer plate when the nozzle plate and the spacer plate are assembled.

According to one example embodiment of the present invention, the spacer plate is shaped to be a semi-circle, a quadrant of a circle, one sixth of a circle, or one eighth of a circle.

With the solution according to embodiments of the present invention, existing partial arc steam turbine may be easily converted to be a full arc admission steam turbine. This will reduce cost of equipment upgrading. Outage due to onsite conversion may be significantly reduced.

BRIEF DESCRIPTION OF THE DRAWINGS

The objects, advantages and other features of the present invention will become more apparent upon reading of the following non-restrictive description of preferred embodiments thereof, given for the purpose of exemplification only, with reference to the accompany drawing, through which similar reference numerals may be used to refer to similar elements, and in which.

DETAILED DESCRIPTION

Figure 1:
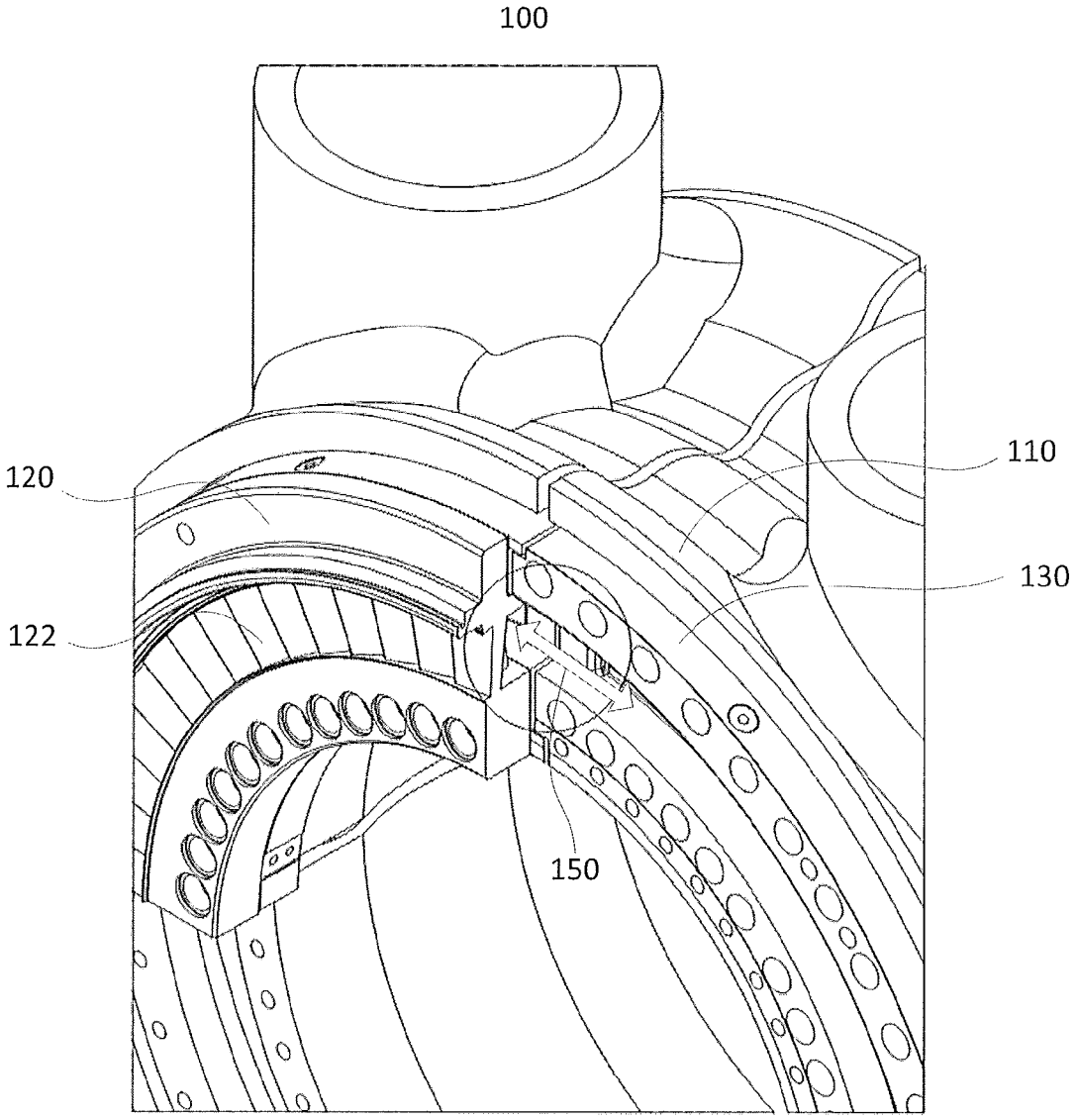
FIG. 1 shows partially a schematic perspective view of a steam turbine according to one example embodiment of the present invention.

FIG. 1 shows a perspective view of a part of a steam turbine 100 according to one example embodiment of the present invention. The steam turbine 100 comprises a plurality of nozzle boxes 110 adapted to intake steam flow from a steam generator, now shown, and a plurality of nozzle plates 120 accommodate the first stage vane therein, for example. As known to those skilled in the art, the steam turbine 100, as generally may be used as a partial arc admission turbine, have each of the nozzle plate 120 connected to respective nozzle box 110 by means of fasteners, such as bolts and nuts. In practice, the steam turbine 100 may comprise two, four, six or eight nozzle boxes 110 for certain application scenarios. Correspondingly, the steam turbine 100 comprises the same amount of nozzle plates 120 to match respective nozzle boxes 110 in order to achieve different types of partial arc admission when the steam turbine 100 is operated under different load conditions.

According to one example embodiment of the present invention, the steam turbine 100 comprises a plurality of spacer plates 130 disposed between the nozzle boxes 110 and the nozzle plates 120, by which a part of a steam flow path 150 as shown by the double-head arrow in FIG. 1 is formed to communicate the nozzle boxes 110 and the nozzle plates 120 through the spacer plates 130, so as to achieve full arc admission for the steam turbine 100. According to embodiments of the present invention, there are the same amount of the spacer plates 130 with that of the nozzle boxes 110 and that of the nozzle plates 120.

As is known to those skilled in the art, a typical partial admission steam turbine utilizes four nozzle boxes and four nozzle plates to distribute steam flow during normal operation thereof, where an outlet of the nozzle box 110 is configured to be a quadrant of a circle, to which a nozzle area 122 of the nozzle plate 120 matches as shown in FIG. 1. In this case, the steam turbine 100 may comprise four spacer plates 130, each of which is used to match respective nozzle box 110 and nozzle plate 120. It should be understood by those skilled in the art that, the spacer plates 130 are not limited to be four, rather the number of the spacer plates 130 corresponds to the number of the nozzle boxes 110 and the nozzle plates 120. For example, the spacer plate 130 may be shaped to be a semi-circle, a quadrant of a circle, one sixth of a circle, or one eighth of a circle, etc. The spacer plate 130 will be described in detail by way of example of four spacer plates 130 being disposed.

Figure 2:
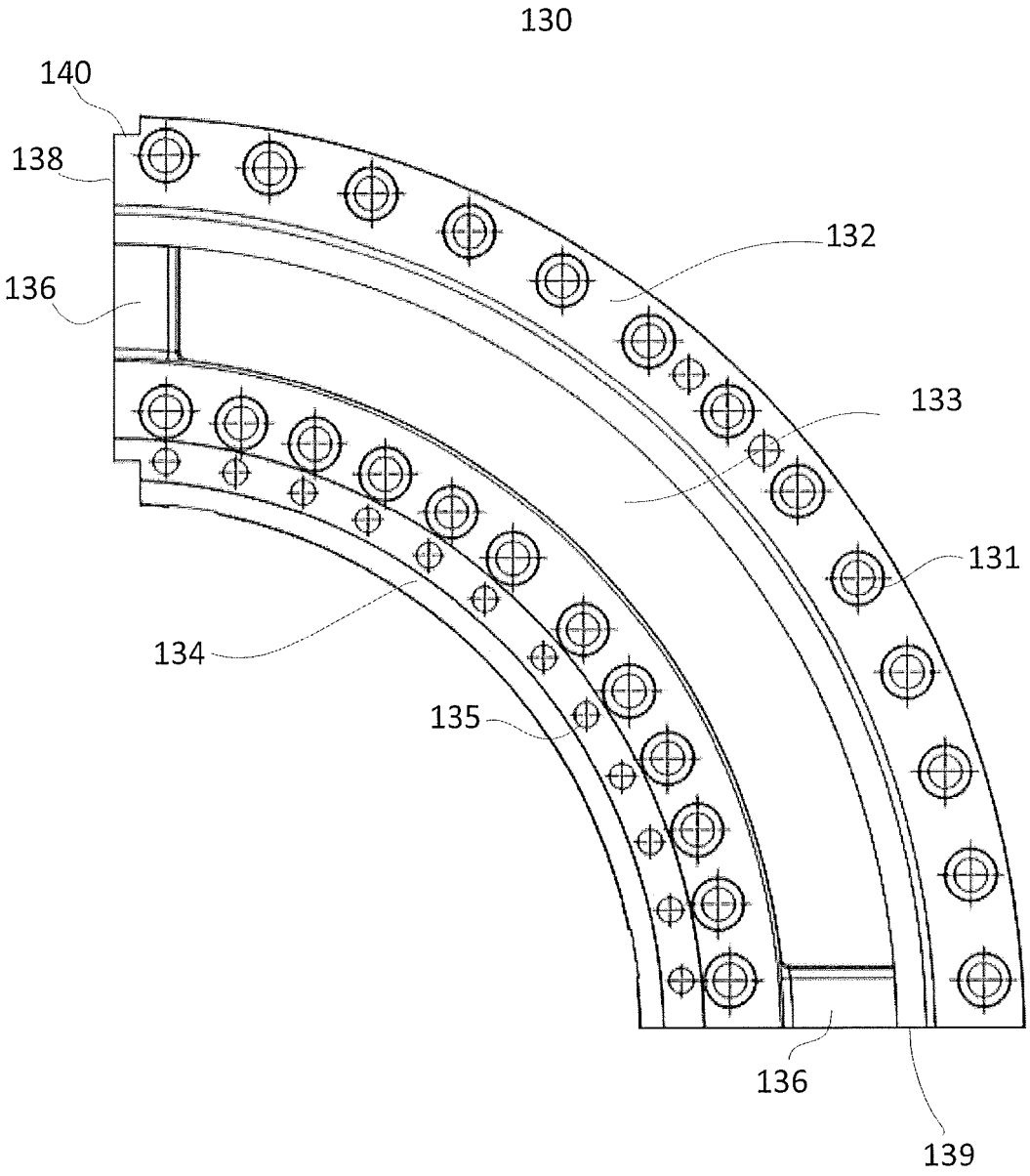
FIG. 2 shows a schematic front view of a spacer plate according to one example embodiment of the present invention.

FIG. 2 shows a front view of the spacer plate 130 according to one example embodiment of the present invention. As shown in FIG. 2, the spacer plate 130 is configured to be a quarter of a circle, and may comprise an outer ring 132, an inner ring 134 connected by link portion 136 substantially positioned at a leading end 138 and a opposite trailing end 139 of the spacer plate 130. A communication space 133 is formed between the outer ring 132 and the inner ring 134 in order to separate the outer ring 132 from the inner ring 134, and communicate with the nozzle box 110 and the nozzle plate 120 as the spacer plate 130 is mounted between them. According to one example embodiment of the present invention, a series of fastener holes 131 are disposed circumferentially on the outer ring 132, and another series of fastener holes 135 are disposed circumferentially on the inner ring 134. As one example implementation, the series of the fastener holes 131 on the outer ring 132 may be used to connect the spacer plate 130 to the nozzle box 110, whereas the series of fastener holes 135 on the inner ring 134 may be used to connect the nozzle plate 120 to the spacer plate 130. It should be understood that the utilization of the fastener holes 131, 135 may be exchanged, i.e. the series of the fastener holes 131 on the outer ring 132 may be used to connect the nozzle plate 120 to the spacer plate 130, whereas the series of fastener holes 135 on the inner ring 134 may be used to connect the spacer plate 130 to the nozzle box 110. Furthermore, according to another example embodiment not shown in the drawings, there may be only one series of fastener holes disposed on the outer ring 132 or inner ring 134 to connect the nozzle plate 120, the spacer plate 130 and the nozzle box 110 together.

Figure 3:
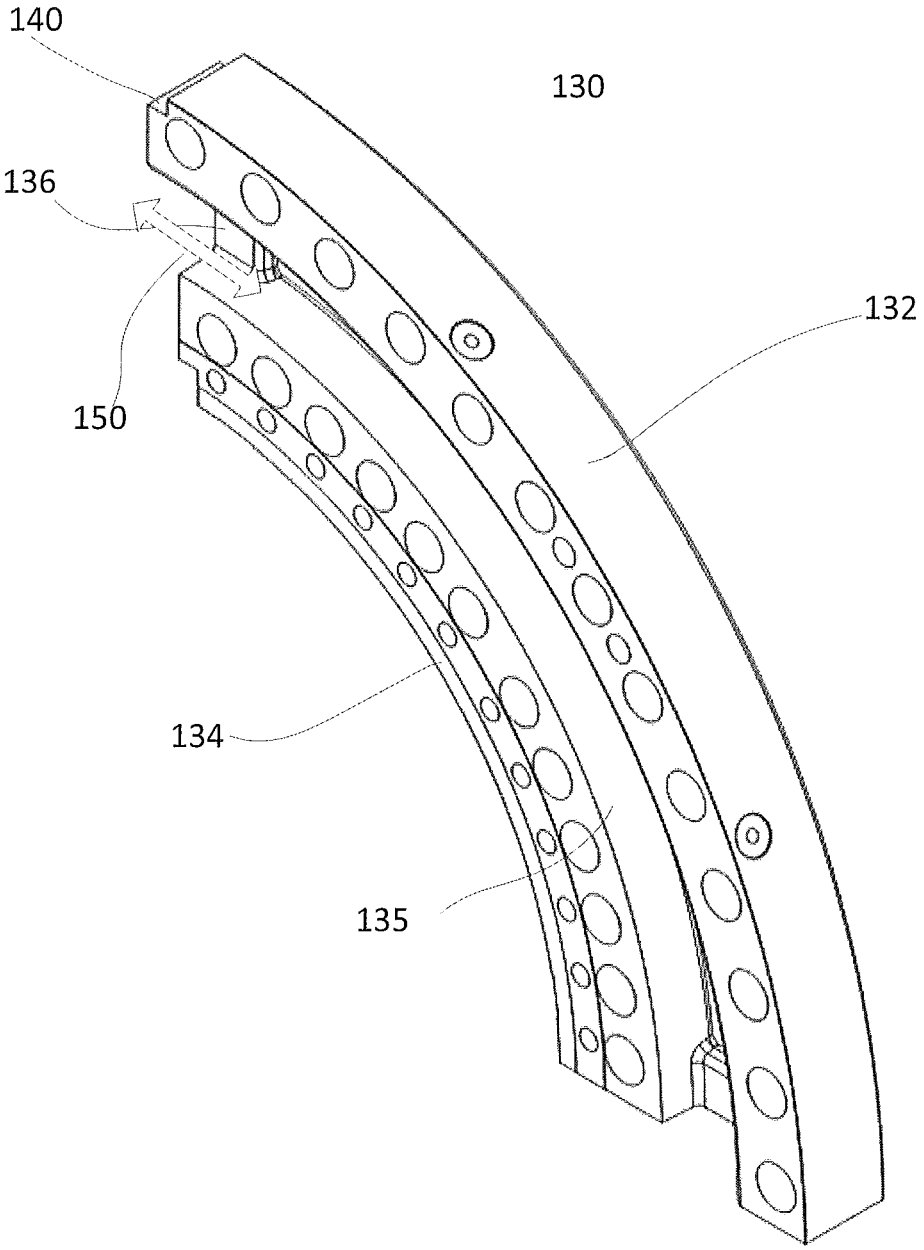
FIG. 3 shows a schematic perspective view of a spacer plate according to one example embodiment of the present invention.

According to one example embodiment, the link portion 136 may have a width less than that of the outer ring 132 and the inner ring 134 as shown in FIG. 3, by which the flow path 150 communicating two adjacent communication spaces 133 may be formed when two adjacent spacer plates 130 are assembled. It should be noted, the term "width", as used herein, refers to a length in an axial direction of the spacer plate 130, in other words, in an axial direction of the nozzle box 110, and in other words, in an axial direction of the steam turbine 100.

Figure 4:
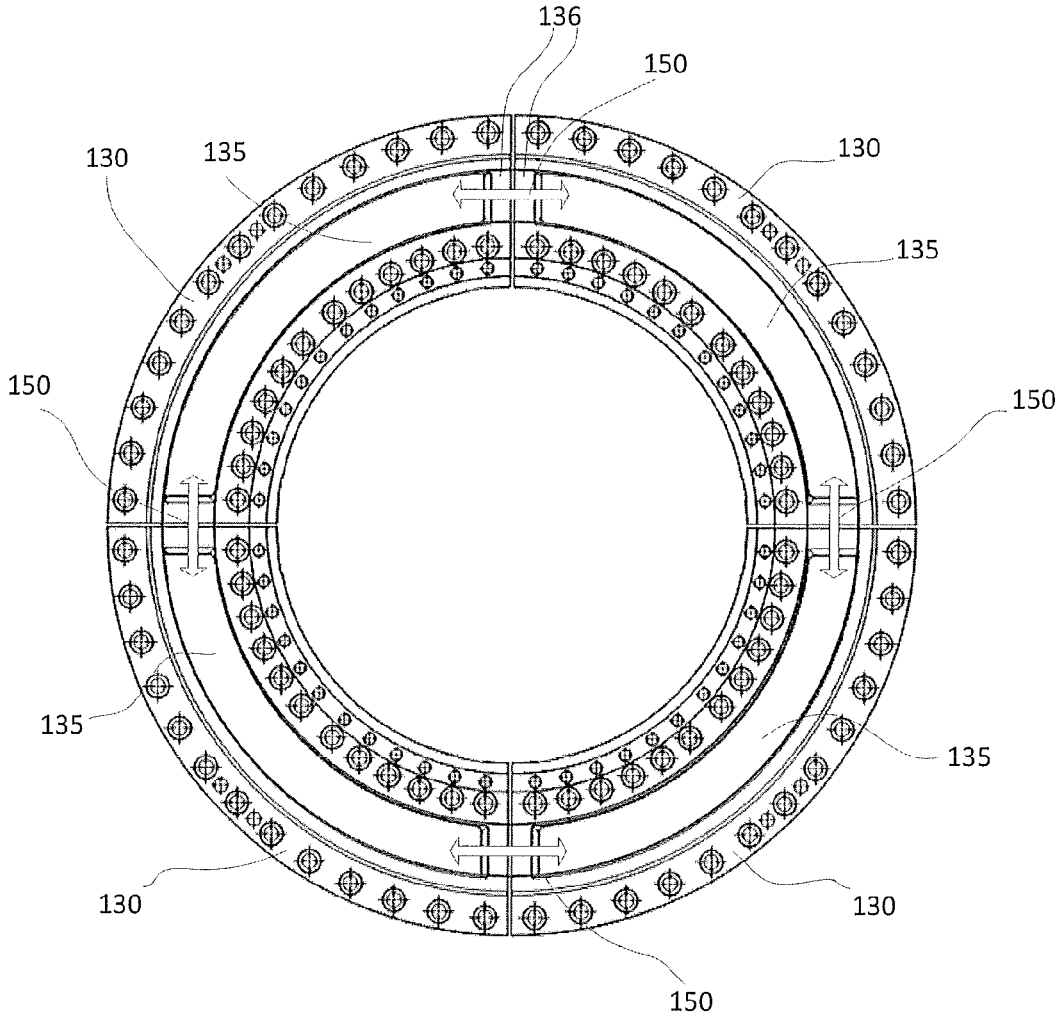
FIG. 4 shows a schematic assemble view of a plurality of spacer plates according to one example embodiment of the present invention.

FIG. 4 shows a front assemble view of spacer plates according to example embodiments of the present invention. As shown in FIG. 4, when two adjacent spacer plates 130 are assembled in a head-to-toe manner, the link portion 136 on the leading end 138 of one of the two adjacent spacer plates 130 rests against the link portion 136 on the trailing end 139 of the other of the two adjacent spacer plates 130. Thanks for the link portions 136 of each of the spacer plates 130, flow paths 150 are formed when the spacer plates, such as four of them, are assembled together in a head-to-toe manner. In other words, a flow path comprises a complete ring shape part around the axial direction of the steam turbine 100 that is formed by the plurality of the spacer plates 130. As shown in FIG. 4, the flow path comprises the part of steam flow path 150 and the communication spaces 133. In this case, a full arc admission may be achieved by the steam turbine 100.

Figure 5:
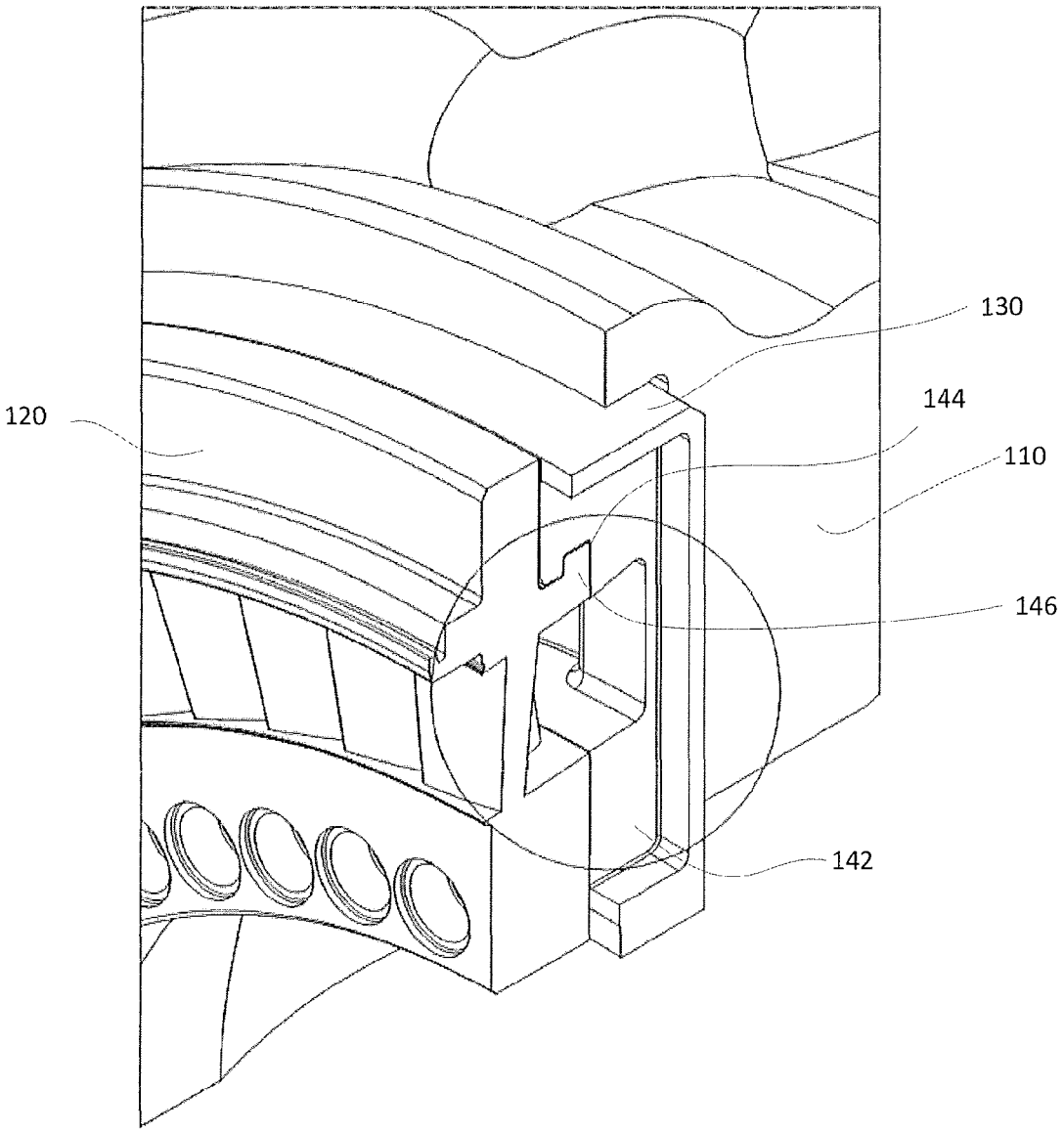
FIG. 5 shows partially a schematic perspective view of the joint between two adjacent spacer plates.

As another example embodiment of the present invention, leakage proof features are provided on the spacer plate 130 in order to prevent steam flow leakage when the spacer plates 130 are assembled during operation. As shown in FIG. 2, a protrusion 140 is disposed on the leading end 138 of the spacer plate 130, which may be fitted with a recess 142 disposed on the trailing end 139 shown in FIG. 2 of the spacer plate 130, as shown in FIG. 5. When the spacer plates 130 are assembled head-to-toe with each other, the protrusion 140 of a preceding spacer plate 130 may engage in the recess 142 of the posterior spacer plate 130, thereby a scarf shaped joint between the two adjacent spacer plates 130 may be formed to prevent steam leakage therebetween.

As one example embodiment of the present invention as shown in FIG. 5, the recess 142 consists of peripheral walls extending from the trailing end 139 shown in FIG. 2 around the trailing end 139 of spacer plate 130, but leave an open side facing the nozzle plate 120 when assembled. This type of recess 142 may further improve sealing performance of the scarf joint between two adjacent spacer plates 130.

Additionally, as shown in the circle in FIG. 5, the nozzle plate 120 is provided a hook 146 on the side facing the spacer plate 130, where the spacer plate 130 comprises a notch 144 complementary in shape to that of the hook 146, at the side facing the nozzle plate 120. In this case, the hook 146 of the nozzle plate 120 may engage with the notch 144 of the spacer plate 130, so as to increase flexibility of design.

With the solution according to embodiments of the present invention, existing partial arc steam turbine may be easily converted to be a full arc admission steam turbine. This will reduce cost of equipment upgrading. Outrage due to onsite conversion may be significantly reduced.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A full arc admission steam turbine comprising a plurality of nozzle boxes for inducing steam, and a plurality of nozzle plates for bearing nozzles, one nozzle plate corresponding to each nozzle box, the steam turbine further comprises a plurality of spacer plates corresponding to the plurality of nozzle boxes, wherein the spacer plate is disposed between the nozzle plate and the nozzle box, by which a flow path is formed between the plurality of nozzle boxes and the plurality of the nozzle plates through the plurality of spacer plates to achieve a full arc admission wherein the spacer plate is configured to be part of a circle, and the spacer plate comprise an outer ring, an inner ring separated from the inner ring by a communication space formed as part of the flow path, and two link portions disposed at opposite leading and trailing ends of the outer ring and the inner ring to connect the outer ring and the inner ring, characterised by the link portion having a less length in an axial direction of the steam turbine than that of the outer ring and the inner ring such that the flow path communicates with two adjacent communication spaces.

2. The full arc admission steam turbine according to claim 1 wherein two adjacent spacer plates are assembled in a head-to-toe manner, the link portion on the leading end of one of the two adjacent spacer plates rests against the link portion on the trailing end of the other of the two adjacent spacer plates.

3. The full arc admission steam turbine according of claim 1 wherein the plurality of the spacer plates are assembled in a head-to-toe manner, the flow path comprises a complete ring shape part around the axial direction of the steam turbine that is formed by the plurality of the spacer plates.

4. The full arc admission steam turbine according to claim 1 wherein two series of fastener holes are disposed on the inner ring and the outer ring of the spacer plate, wherein one series of the two series of fastener holes is used to connect the spacer plate to the nozzle box, respectively, and the other series of the two series of fastener holes is used to connect the nozzle plate to the spacer plate, respectively.

5. The full arc admission steam turbine according to claim 1 wherein, one series of fastener holes are disposed on the inner ring, or the outer ring, or both, of the spacer plate so as to be used to connect the nozzle plate, the spacer plate and the nozzle box together.

6. The full arc admission steam turbine according to claim 1 wherein the spacer plate comprises on its leading end a protrusion and a recess on its trailing end, where, when two adjacent spacer plates are assembled, the protrusion on the leading end of one of the two spacer plates engage with the recess on the trailing end of the other of the two spacer plates.

7. The full arc admission steam turbine according to claim 1 wherein the recess on the trailing end of the spacer plate consists of peripheral walls around the trailing end of the spacer plate, leaving an open side facing the nozzle plate when assembled.

8. The full arc admission steam turbine according to claim 1 wherein the spacer plate is shaped to be a semi-circle, a quadrant of a circle, one sixth of a circle, or one eighth of a circle.

* * * * *